United States Patent [19]

Reinehr et al.

[11] 4,438,060

[45] Mar. 20, 1984

[54] PROCESS FOR PRODUCING CROSS-SECTIONALLY STABLE, HYGROSCOPIC FIBERS AND FILAMENTS HAVING A CORE-JACKET STRUCTURE

[75] Inventors: Ulrich Reinehr; Toni Herbertz, both of Dormagen; Hermann-Josef Jungverdorben, Grevenbroich, all of Fed. Rep. of Germany

[73] Assignee: Bayer Aktiengesellschaft, Leverkusen, Fed. Rep. of Germany

[21] Appl. No.: 210,467

[22] Filed: Nov. 24, 1980

[30] Foreign Application Priority Data

Nov. 28, 1979 [DE] Fed. Rep. of Germany ..... 2947824

[51] Int. Cl.[3] ..... D01F 6/18

[52] U.S. Cl. ..... 264/206; 428/398

[58] Field of Search ..... 264/206, 182, 49; 428/398; 525/147, 148, 222, 238

[56] References Cited

U.S. PATENT DOCUMENTS

| | | | |
|---|---|---|---|
| 1,996,753 | 4/1935 | Dreyfus | 264/207 |
| 2,062,405 | 12/1936 | Dreyfus | 264/78 |
| 2,073,414 | 3/1937 | Dosne | 264/78 |
| 2,075,888 | 4/1937 | Dreyfus | 264/211 |
| 2,376,934 | 4/1945 | Morgan | 264/78 |
| 2,851,435 | 9/1958 | Pirot | 525/238 |
| 3,110,548 | 11/1963 | Fukushima et al. | 264/182 |
| 3,410,819 | 11/1968 | Kourtz et al. | 264/182 |
| 3,773,884 | 11/1973 | Shimoraka et al. | 264/182 |
| 4,012,459 | 3/1977 | Takaya et al. | 525/148 |
| 4,046,843 | 9/1977 | Sano et al. | 264/49 |
| 4,100,238 | 7/1978 | Shinomara | 264/49 |
| 4,143,200 | 3/1979 | Radleman et al. | 264/206 |
| 4,185,038 | 1/1980 | Reinehr et al. | 264/206 |
| 4,185,059 | 1/1980 | Reinehr et al. | 264/206 |
| 4,197,148 | 4/1980 | Shinomara | 264/49 |
| 4,224,269 | 9/1980 | Reinehr et al. | 264/206 |
| 4,239,722 | 12/1980 | Reinehr et al. | 264/206 |
| 4,257,999 | 3/1981 | Reinehr et al. | 264/206 |
| 4,356,134 | 10/1982 | Reinehr et al. | 264/206 |

FOREIGN PATENT DOCUMENTS

| | | | |
|---|---|---|---|
| 2901778 | 7/1979 | Fed. Rep. of Germany | 284/182 |
| 238072 | 7/1969 | U.S.S.R. | 284/182 |

*Primary Examiner*—Jay H. Woo

*Attorney, Agent, or Firm*—Sprung, Horn, Kramer & Woods

[57] ABSTRACT

Hygroscopic filaments or fibers with a core-jacket structure of hydrophobic, filament-forming synthetic polymers having a water retention capacity of at least 10% and having uniform round to oval cross-sectional profiles are obtained by a dry-spinning process which comprises addition of a substance to the spinning solvent which (a) has a higher boiling point than the spinning solvent used,
(b) is readily miscible with the spinning solvent and with water,
(c) is a non-solvent for the polymer to be spun, and addition of another substance which (a) is soluble in the non-solvent for the polymer to be spun,
(b) is soluble in the solvent for the polymer
(c) remains dissolved in the non-solvent for the polymer during solidification of the filaments,
(d) is insoluble in water, and
(e) does not evaporate to any significant extent during the spinning process, to the system in quantities of at least 1% by weight, based on polymer solids/spinning solvent/non-solvent carrying out the spinning process in such a way that the non-solvent does not evaporate to any significant extent in the spinning duct and washing out the non-solvent from the solidified filaments.

5 Claims, No Drawings

PROCESS FOR PRODUCING CROSS-SECTIONALLY STABLE, HYGROSCOPIC FIBERS AND FILAMENTS HAVING A CORE-JACKET STRUCTURE

According to German Offenlegungsschrift No. 25 54 124, hygroscopic filaments and fibres may be produced from hydrophobic filament-forming synthetic polymers by adding to the spinning solvent from 5 to 50% by weight, based on the solvent and solids, of a substance which is essentially a non-solvent for the polymer, which has a higher boiling point than the solvent used and which is readily miscible with the spinning solvent and with a liquid suitable as a washing liquid for the filaments, and subsequently washing out this non-solvent from the filaments produced. Preferred non-solvents in this process are polyhydric alcohols, such as glycerol, sugar and glycols.

Although the filaments and fibres obtainable by this process show an outstanding capacity for absorbing water and have a round to trilobal cross-sectional form in the spun material, this cross-sectional form collapses during the after-treatment, generally into star-like to bizarre profiles. The main factors which influence the cross-sectional form are the drawing, drying and steaming process. During further processing into textiles, fibres having bizarre cross-sectional profiles such as these can give rise to fluffy and hairy yarns, a rough feel or an increased proportion of short fibres through breaks in the yarn.

Accordingly, an object of the present invention is to provide hygroscope fibres and filaments having largely uniform, round to oval cross-sections which retain their profile during the after-treatment of the spun material and which are therefore easier to make up into textiles.

A further object of the present invention is a process for the production of hygroscopic filaments or fibers having a core-jacket structure and uniform round to oval cross-sectional profiles from hydrophobic, filament-forming synthetic polymers by a dry-spinning process which process comprises addition of a substance to the spinning solvent which (a) has a higher boiling point than the spinning solvent used, (b) is readily miscible with the spinning solvent and with water, (c) is a non-solvent for the polymer to be spun, and addition of another substance which (a) is soluble in the non-solvent for the polymer to be spun, (b) is soluble in the solvent for the polymer (c) remains dissolved in the non-solvent for the polymer during solidification of the filaments, (d) is insoluble in water, and (e) does not evaporate to any significant extent during the spinning process, to the system in quantities of at least 1% by weight, based on polymer solids/spinning solvent/non-solvent carrying out the spinning process in such a way that the non-solvent does not evaporate to any significant extent in the spinning duct and washing out the non-solvent from the solidified filaments.

Substances which satisfy these requirements are, for example, polymeric compounds from the series of polycarbonates, polystyrenes, polyvinyl acetates and cellulose acetate derivatives.

A preferred hydrophobic filament-forming synthetic polymer is an acrylonitrile polymer, especially a polymer with at least 40% by weight of acrylonitrile units and preferably with at least 80% by weight of acrylonitrile units.

In this process, filaments and fibres are obtained from hydrophobic polymers which, in addition to the required uniform round to oval cross-sectional profiles, have a water-retention capacity of at least 10% and a core-jacket structure in which the core is highly microporous, the pores predominantly communicating with one another, and the jacket surrounding the core is considerably more compact than the core, but permeated by passages which allow liquids to enter the pore system of the core. Filaments and fibres having core/jacket structures of the type in question are described inter alia in German Offenlegungsschrift No. 25 54 124, which was mentioned at the beginning, and in German Offenlegungsschrift No. 27 19 019.

By virtue of the fact that the further spinning additives used in the process according to the invention remain dissolved in the non-solvent for the polymer solids, for example glycerol for polyacrylomitrile, during solidification of the filaments and are only precipitated on contact with water, they fill the pores formed in the filaments when the non-solvent is washed out. Because the additives are incorporated into the pore system of the fibres, the vacuole structure of filaments of the type in question is stabilised by the formation of strong cell walls inside the fibres, as shown by photographs taken with a scanning electron microscope. This effect spreads from the fibre core outwards so that uniform cross-sectional structures are obtained. The following observation is proof of the fact that polymeric additives of the type in question remain dissolved in the non-solvent during solidification of the filament:

If samples of spun material are examined under a microscope in transmitted light, they appear bright white as long as they do not come into contact with water. When water is added, however, a dark fibre core and a light outer jacket are obtained through precipitation of the polymeric substance added. If a polycarbonate, for example, is used as the polymeric additive, it may be subsequently recovered quantitatively, for example from hygroscopic polyacrylonitrile fibres, for example by extraction with methylene chloride. If compounds which do not satisfy the above-mentioned requirements are used, no cross-section-stabilising effect is obtained. If an acrylonitrile homopolymer, for example, is used as the polymeric additive, it may well be soluble in the spinning solvent, DMF, but is not soluble in the non-solvent, for example in glycerol or glycols. Bizarre to worm-like cross-sectional profiles are obtained after the spun material has been after-treated to form fibres or filaments. As series of tests carried out with different concentrations of polymeric additives have shown, from 1 to 5% by weight and preferably from 1.5 to 4% by weight, based on the weight of the polymer solids/spinning solvent/non-solvent system, are sufficient in practice for obtaining a cross-section-stabilising effect on the fibres.

Another important advantage of the invention lies in the fact that not only do fibres of the type in question not have any of the disadvantages referred to above during further processing, but they additionally have a very stable pore system which is far less sensitive during make-up processes, such as steaming, ironing and the like. In addition, the spun-in additives bring about an increase in the water retention capacity which contributes to the comfort properties of fibres of the type in question.

An additional advantage arises out of the fact that the fibres according to the invention are also less sensitive to shrinkage processes during drying and largely retain their cross-sectional structure. In this way, it is possible to produce hydrophilic fibres and filaments having a core/jacket structure on an industrial scale, even in tow form.

Another major advantage discovered in tests was that tows of the type in question lose moisture through drying much more quickly and to a greater extent that tows without additives of the type in question. As a result, it was possible to improve flock make-up and considerably to increase output.

Determination of Water Retention Capacity (WR)

The water retention capacity is determined in accordance with DIN 53 814 (cf. Melliand Textilberichte 4, 1973, page 350).

The fibre samples were immersed in water containing 0.1% of wetting agent for 2 hours. The fibres were than centrifuged for 10 minutes with an acceleration of 10,000 m/sec$^2$ and the quantity of water retained in and between the fibres was determined gravimetrically. To determine their dry weight, the fibres were dried at 105° C. until a constant moisture content was achieved. The WR in percent by weight is:

$$WR = \frac{m_f - m_{tr}}{m_{tr}} \times 100$$

in which $m_f$=the weight of the moist fibres, $m_{tr}$=the weight of the dry fibres.

The invention is illustrated by the following Examples in which the parts and percentages quoted are by weight.

EXAMPLE 1

(a) 10 kg of dimethyl formamide and 2.5 kg of polycarbonate (polycarbonic acid ester of 4,4'-dihydroxydiphenyl-2,2-propane, MW approximately 80,000) are dissolved with stirring at 130° C. in an autoclave. The resulting solution is then added with stirring at room temperature to a mixture of 50 kg of DMF and 17.5 kg of tetraethylene glycol. 20 kg of an acrylonitrile copolymer (chemical composition: 93.6% of acrylonitrile, 5.7% of methyl acrylate and 0.7% of sodium methallyl sulphonate) are then added with stirring at room temperature. The quantity of polycarbonate added amounts to 2.5%, based on polymer solids/spinning solvent/non-solvent. The suspension was delivered by a gear pump to a heating unit and heated to 130° C. The residence time in the heating unit was 3 minutes. The spinning solution was then filtered and dry-spun in known manner in a spinning duct from a 240-bore spinning jet. The spun material (denier 1580 dtex) was collected on bobbins and doubled to form a tow having an overall denier of 110,600 dtex. The tow was then drawn in a ratio of 1:4.0 in boiling water, washed with water at 80° C., provided with an antistatic preparation and dried under tension at 100° C. in a screen drum dryer. The tow leaves the dryer with a moisture content of 41.5%. The tow is then crimped in a stuffer box and at the same time cut into fibres having a staple length of 60 mm. The individual fibres with a final denier of 2.6 dtex have a strength of 2.2 centi-Newtons/dtex and an elongation of 32%. Their water retention capacity amounts to 46%. As shown by photographs taken under an optical microscope and magnified 700 times, the fibres show a pronounced core/jacket structure with completely uniform, round cross-sectional profiles. As further shown by photographs taken with a scanning electron microscope and magnified 1000 times, the pore system is permeated by 2 to 5$\mu$ thick cell walls.

(b) Part of the tow was branched off, drawn in a ratio of 1:4.0 in boiling water, washed, provided with an antistatic preparation and then dried under tension at various temperatures with 20% permitted shrinkage, crimped and processed to form staple fibres. The individual measured data are set out in Table I. As can be seen from Table I, uniform round to oval cross-sectional forms are obtained in every case.

(c) In another series of tests, the quantity of added polycarbonate was varied to ascertain the level beyond which a cross-section-stabilising effect is obtained in the hygroscopic core/jacket fibres. The spinning tests were carried out in the same way as described in (a). The fibre cross-sections were assessed by an optical microscope (magnification 700×). The cross-sections were obtained by embedding in methyl methacrylate. As can be seen from Table II, a cross-section-stabilising effect occurs beyond about 1% by weight of added substance.

TABLE I

| No. | After-treatment | Tow moisture after dryer % | Denier dtex | Strength cN/dtex | Elongation % | WR % | Cross-sectional profile |
|---|---|---|---|---|---|---|---|
| 1 | 160° C. dr. temp./ tension | 30 | 2.4 | 2.2 | 26 | 45 | round to oval |
| 2 | 100° C. dr. temp.20% shrinkage | 11 | 2.6 | 2.3 | 33 | 46 | round to oval |
| 3 | 160° dr. temp./20% shrinkage | 3.2 | 2.7 | 2.1 | 36 | 24 | round to oval |

TABLE II

| | Composition of the spinning solution in % by weight | | | | WR | |
|---|---|---|---|---|---|---|
| No. | PAN | Polycarbonate | Tetraethylene glycol | DMF | % | Cross-sectional profile |
| 1 | 22.188 | 0.312 | 17.5 | 60 | 30 | bizarre, star-like |
| 2 | 21.85 | 0.625 | 17.5 | 60 | 31 | worm-like, lapped |
| 3 | 21.25 | 1.25 | 17.5 | 60 | 39 | round to oval |
| 4 | 20 | 3.0 | 17.5 | 60 | 50 | circular |

TABLE II-continued

| No. | Composition of the spinning solution in % by weight PAN | Polycarbonate | Tetraethylene glycol | DMF | WR % | Cross-sectional profile |
|---|---|---|---|---|---|---|
| 5 | 17.5 | 5.0 | 17.5 | 60 | 76 | circular |

EXAMPLE 2

(a) 10 kg of dimethyl formamide and 2.5 kg of polyvinyl acetate (Movilith 30) are dissolved with stirring at 120° C. in an autoclave. The resulting solution is then added with stirring at room temperature to a mixture of 50 kg of DMF and 17.5 kg of triethylene glycol. 20 kg of an acrylonitrile copolymer having the same chemical composition as in Example 1 are then added with stirring at room temperature. The quantity of polyvinyl acetate added amounts to 2.5%, based on polymer solids/spinning solvent/non-solvent. As described in Example 1, the suspension was then converted into a spinning solution, filtered and, again as described in Example 1, spun into filaments and after-treated to form fibres having a final denier of 2.2 dtex. The tow left the dryer with a moisture content of 51%. The fibres have a strength fo 2.6 centi-Newtons/dtex, an elongation of 30% and a water retention capacity of 52%. As shown by the photographs taken under an optical microscope and magnified 700 times, the fibres show a pronounced core/jacket structure with uniform, round cross-sectional forms. Photographs taken with a scanning electron microscope and magnified 1000 times again show 2 to 5μ thick cell walls in the pore system.

(b) Part of the tow was again branched off, drawn in a ratio of 1:4.0, washed, provided with an antistatic preparation and then dried under tension at various temperatures with 20% permitted shrinkage, crimped and processed to form staple fibres. The individual measured data are set out in Table III. As can be seen from Table III, uniform round to oval cross-sectional profiles are obtained in every case.

TABLE III

| No. | After-treatment | Tow moisture after dryer % | Denier dtex | Strength cN/dtex | Elongation % | WR % | Cross-sectional profile |
|---|---|---|---|---|---|---|---|
| 1 | 160° C. dr. temp./ tension | 20 | 2.0 | 3.0 | 30 | 34 | round to oval |
| 2 | 100° C. dr. temp./20% shrinkage | 20 | 2.2 | 2.6 | 32 | 40 | round to oval |
| 3 | 160° C. dr. temp./20% shrinkage | 4 | 2.2 | 2.7 | 32 | 21 | round to oval |

EXAMPLE 3

(a) 60 kg of dimethyl formamide are stirred with 2.5 kg of cellulose acetate (cellulose acetate linters esterified with butyric acid), 17.5 kg of glycerol and 20 kg of an acrylonitrile copolymer having the same composition as in Example I in an autoclave at room temperature to form a suspension. The suspension is then converted into a spinning solution, filtered and the spinning solution is spun into filaments and after-treated to form fibres having a final denier of 2.3 dtex in the same way as described in Example I. The tow left the dryer with a moisture content of 54%. The fibres have a strength of 2.6 centi-Newtons/dtex, an elongation of 29% and a water retention capacity of 45%. As shown by photographs taken under an optical microscope and magnified 700 times, the fibres have a core/jacket structure with uniform, round cross-sectional profiles. Photographs taken with a scanning electron microscope and magnified 1000 times again show 2 to 5μ thick cell walls in the pore system.

(b) Part of the tow was again branched off and variously after-treated in the same way as described in Example Ib. The individual measured data are shown in Table IV. As can be seen, uniform round to oval cross-sectional structures are again obtained in every case.

TABLE IV

| No. | After-treatment | Tow moisture after dryer % | Denier dtex | Strength cN/dtex | Elongation % | WR % | Cross-sectional profile |
|---|---|---|---|---|---|---|---|
| 1 | 160° C. dr. temp./ tension | 26 | 3.2 | 2.6 | 29 | 41 | round to oval |
| 2 | 100° C. dr. temp./20% shrinkage | 8 | 2.3 | 2.7 | 31 | 47 | round to oval |
| 3 | 160° C. dr. temp./20% shrinkage | 3 | 2.3 | 2.7 | 32 | 19 | round to oval |

EXAMPLE 4

(Comparison)

(a) 60 kg of dimethyl formamide and 17.5 kg of tetraethylene glycol are mixed with stirring in an autoclave at room temperature. 20 kg of an acrylonitrile copolymer having the same chemical composition as in Example 1 are then added and the suspension is converted into a spinning solution, filtered and spun into filaments in the same way as described in Example 1. The spun material collected is then after-treated to form fibres having a final denier of 2.7 dtex in the same way as described in Example 1. The tow left the dryer with a moisture content of 75%. The fibres have a strength of 2.5 centi-Newtons/dtex, an elongation of 39% and a water retention capacity of 30%. As shown by photographs taken with an optical microscope and magnified 700 times, the fibres show a pronounced core/jacket structure with bizarre to star-shaped irregular cross-sectional profiles. Photographs taken with a scanning electron microscope and magnified 1000 times show relatively thin cell walls (1 to 2μthick) in the pore system.

(b) Part of the tow was again branched off and variously after-treated in the same way as described in Example 1b. The individual data are set out in Table V. As can be seen, bizarre, irregular to star-shaped fibre cross-sectional structures are obtained in every case.

TABLE V

| No. | After-treatment | Tow moisture after dryer % | Denier dtex | Strength cN/dtex | Elongation % | WR % | Cross-sectional profile |
|---|---|---|---|---|---|---|---|
| 1 | 160° C. dr. temp./ tension | 57 | 2.3 | 2.4 | 31 | 28 | star-shaped, bizarre |
| 2 | 100° C. dr. temp./20% shrinkage | 40 | 2.6 | 2.1 | 38 | 30 | star-shaped, bizarre |
| 3 | 160° C. dr. temp/20% shrinkage | 14.4 | 2.6 | 2.2 | 37 | 13 | star-shaped, very bizarre |

EXAMPLE 5

(Comparison)

(a) 62.5 kg of dimethyl formamide are stirred with 2.5 kg of acrylonitrile homopolymer (K-value 90), 15 kg of triethylene glycol and 20 kg of an acrylonitrile copolymer having the same chemical composition as in Example 1 in an autoclave at room temperature to form a suspension. The suspension is then converted into a spinning solution, filtered and the spinning solution is spun into filaments in the same way as described in Example 1. As can be determined by preliminary tests, the acrylonitrile homopolymer used as a cross-section-stabilising additive is completely insoluble in triethylene glycol, even at elevated temperature. The filaments are again collected, doubled to form a tow and after-treated to form fibres having a final denier of 2.3 dtex in the same way as described in Example 1. The tow left the dryer with a moisture content of 83%. The fibres have a strength of 2.7 centi-Newtons/dtex, an elongation of 35% and a water retention capacity of 38%. As shown by photographs taken with an optical microscope and magnified 700 times, the fibres have a core/jacket structure with irregular worm-shaped to rodlet-shaped bizarre cross-sectional profiles. Photographs taken with a scanning electron scan microscope and magnified 1000 times show relatively thin cell walls (1 to 2μ thick) in the pore system.

(b) Part of the tow was again branched off and variously after-treated in the same way as described in Example 1b. The individual data are set out in Table VI. As can be seen from the Table, irregular, bizarre worm-shaped cross-sectional profiles are formed in every case. An addition to the polymer solids/spinning solvent/non-solvent system only has a cross-section-stabilising effect when it is soluble in the non-solvent, remains in the system during the spinning process and is only precipitated in the course of the after-treatment, for example by washing, and the pore system permeates the hydrophilic core/jacket fibres from inside. This also accounts for the stronger skeletal structure of the pore system in the form of thicker cell walls by comparison with a porous fibre containing no such addition.

TABLE VI

| No. | After-treatment | Tow moisture after dryer % | Denier dtex | Strength cN/dtex | Elongation % | WR % | Cross-sectional profile |
|---|---|---|---|---|---|---|---|
| 1 | 160° C. dr. temp./ tension | 50 | 2.1 | 2.9 | 29 | 27 | worm-shaped bizarre |
| 2 | 100° C. dr. temp./20% shrinkage | 38 | 2.5 | 2.6 | 39 | 28 | worm-shaped bizarre |
| 3 | 160° C. dr. temp./20% shrinkage | 12 | 2.3 | 2.7 | 36 | 11 | worm-shaped bizarre |

We claim:

1. A process for the production of hygroscopic polyacrylonitrile filaments with fibers containing at least 80% by weight of acrylonitrile units which filaments or fibers have a core-jacket structure and uniform round to oval cross-sectional profiles from hydrophobic, filament forming synthetic polyacrylonitrile polymer containing at least 80% by weight of acrylonitrile units by a dry-spinning process which comprises addition of a substance to the spinning solvent which
   a. has a higher boiling point than the spinning solvent used,
   b. is readily soluble with the spinning solvent and with water,
   c. is a non-solvent of the polymer to be spun; and
   d. is selected from the group consisting of polyhydric alcohols, sugars and glycols, and addition of another substance which
   a. is soluble in the non-solvent of the polymer to be spun
   b. is soluble in the solvent to the polymer
   c. remains dissolved in the non-solvent for the polymer during solidification of the filaments,
   d. is insoluble in water,
   e. does not evaporate to any significant extent during the spinning process, and
   f. is selected from the group consisting of polycarbonate, polystyrene, polyvinyl acetate and cellulose acetate to the system in quantities of 1 to 5% by weight, based on polymers solid/spinning/non-solvent, carrying out the spinning process in such a way that the non-solvent does not evaporate to any significant extent in the spinning duct and washing out the non-solvent from the solidified filaments.

2. A process according to claim 1 wherein said another substance is a polycarbonate.

3. A process according to claim 1 wherein said another substance is a polystyrene.

4. A process according to claim 1 wherein said another substance is a polyvinyl acetate.

5. A process according to claim 1 wherein said another substance is a cellulose acetate.

* * * * *